US008810470B2

(12) United States Patent
Heckler et al.

(10) Patent No.: US 8,810,470 B2
(45) Date of Patent: Aug. 19, 2014

(54) DUAL BAND ANTENNA, IN PARTICULAR FOR SATELLITE NAVIGATION APPLICATIONS

(75) Inventors: Marcos Vinicio Thomas Heckler, Alegrete (BR); Enrique Nova Lavado, Barcelona (ES)

(73) Assignee: Deutsches Zentrum für Luft- und Raumfahrt e.V., Cologne (DE)

( * ) Notice: Subject to any disclaimer, the term of this patent is extended or adjusted under 35 U.S.C. 154(b) by 461 days.

(21) Appl. No.: 13/147,306

(22) PCT Filed: Jan. 28, 2010

(86) PCT No.: PCT/EP2010/051021

§ 371 (c)(1),
(2), (4) Date: Aug. 1, 2011

(87) PCT Pub. No.: WO2010/086383

PCT Pub. Date: Aug. 5, 2010

(65) Prior Publication Data

US 2011/0291909 A1 Dec. 1, 2011

(30) Foreign Application Priority Data

Jan. 31, 2009 (DE) ..... 10 2009 006 988

(51) Int. Cl.

| | |
|---|---|
| ***H01Q 1/48*** | (2006.01) |
| ***H01Q 1/52*** | (2006.01) |
| ***H01Q 1/38*** | (2006.01) |
| ***H01Q 9/04*** | (2006.01) |
| ***H01Q 1/24*** | (2006.01) |

(52) U.S. Cl.

CPC ..... *H01Q 9/0414* (2013.01); *H01Q 1/521* (2013.01); *H01Q 1/38* (2013.01); *H01Q 9/0457* (2013.01); *H01Q 1/243* (2013.01); *H01Q 9/0428* (2013.01)

USPC ..... 343/846

(58) Field of Classification Search

USPC ..... 343/700 MS, 702, 846

See application file for complete search history.

(56) References Cited

U.S. PATENT DOCUMENTS 6,556,169 B1 * 4/2003 Fukuura et al. ..... 343/700 MS
7,084,815 B2 * 8/2006 Phillips et al. ..... 343/700 MS (Continued)

FOREIGN PATENT DOCUMENTS

EP 0856907 8/1998

OTHER PUBLICATIONS

International Search Report corresponding to International Application No. PCT/EP2010/051021, dated Dec. 13, 2010.

(Continued)

*Primary Examiner* — Seung Lee

(74) *Attorney, Agent, or Firm* — Renner, Otto, Boisselle & Sklar, LLP

(57) ABSTRACT

The invention relates to a dual band antenna, in particular for satellite navigation applications, comprising a multilayer structure that is provided with an upper first antenna element (12) for receiving electromagnetic waves having a frequency in a first frequency band, a lower second antenna element (16) arranged below the first antenna element (12) for receiving electromagnetic waves having a frequency in a second frequency band, two electrically conductive ground layers (20, 28), a first and a second one, that are arranged one above the other and that are arranged in turn below the lower second antenna element (16), and a conducting-path layer (24) having at least one first conductive path (30,32) for electromagnetically coupling with the first antenna element (12) and having at least one second conductive path (34,36) for electromagnetically coupling with the second antenna element (16). The first ground layer (20) facing the lower second antenna element (16) comprises an aperture (40,42), below which the at least one second conductive path (34,36) extends. The at least one first conductive path (30,32) is connected to the upper first antenna element (12) by means of an electrical conductor (46,48) that extends through the first ground layer (20) and the lower second antenna element (16) in such a way that the electrical conductor is electrically insulated from the first ground layer and the lower second antenna element. Furthermore, the multilayer structure is provided with a first line adjustment element (58,60,62,64) coupled with the at least one first conductive path (30,32) for suppressing the coupling into the first conductive path (30,32) of electromagnetic waves having a frequency in the second frequency band which are received by means of the lower second antenna element (16) and coupled into the electrical conductor (46,48), a second line adjustment element (44) coupled with the at least one second conductive path (34,36) for suppressing the coupling into the second conductive path (34,36) of electromagnetic waves in the first frequency band which are received by means of the upper first antenna element (12), and several dielectric layers (14,18,22,26) that are arranged betweeen the antenna elements(12,16), ground layers (20,28), and conducting-path layer(24) that lie one above the other.

9 Claims, 2 Drawing Sheets

(56) References Cited

U.S. PATENT DOCUMENTS

Figure 1:
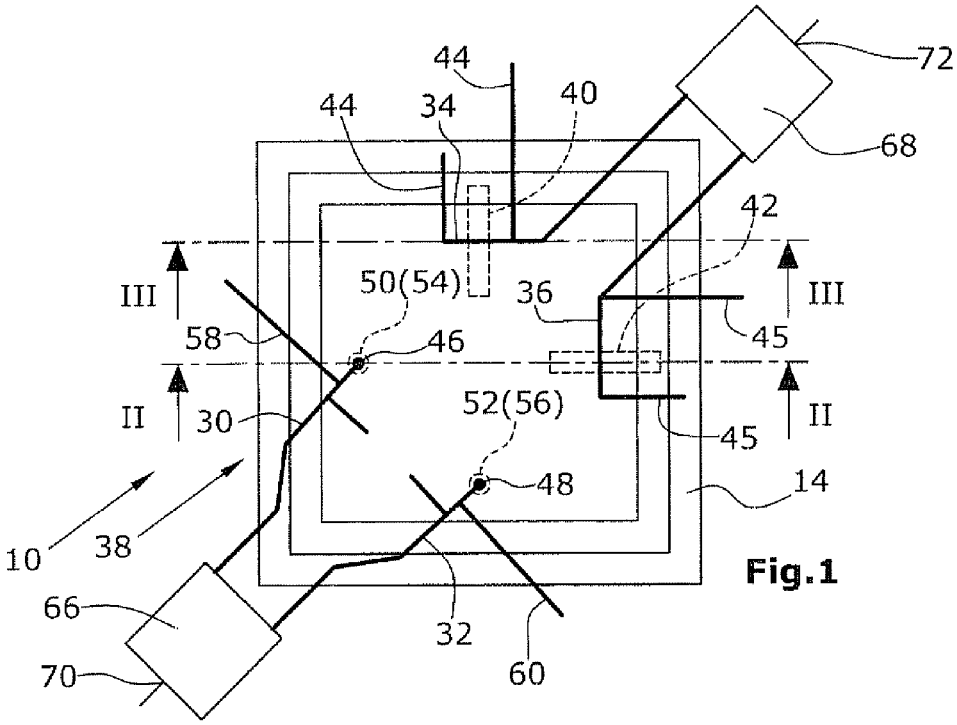

| | | | | |
|---|---|---|---|---|
| 7,253,770 | B2 * | 8/2007 | Yegin et al. | 343/700 MS |
| 8,059,049 | B2 * | 11/2011 | Quan et al. | 343/770 |
| 8,289,213 | B2 * | 10/2012 | Duchesne et al. | 343/700 MS |

OTHER PUBLICATIONS

Bing Bai et al, "Stacked Dual-Band Circularly Polarized Microstrip Patch Antenna", Microwave, Antenna, Propagation and EMC Technologies for Wireless Communications, 2007 International Symposium On, IEEE, PI, Aug. 1, 2007, pp. 706-709.

David M. Pozar, et al., "A Dual-Band Circularly Polarized Aperture-Coupled Stacked Microstrip Antenna for Global Positioning Satellite", IEEE Transactions on Antennas and Propagation, IEEE Service Center, Piscataway, NJ, US, vol. 45, No. 11, Nov. 1, 1997.

Ferrero F. et al., "Dual-Band Circularly Polarized Microstrip Antenna for Satellite Applications", IEEE Antennas and Wireless Propagation Letters, IEEE, Piscataway, NJ, US, vol. 4, No. 1, Dec. 1, 2005, pp. 13-3.

Heckler M. V. T., et al., "Dual-Band Circularly Polarized Microstrip Antenna With Two Isolated Outputs Suitable for Navigation Systems", Antennas and Propagation.Society International Symposium, 2009, Apsursi '09, IEEE, Piscataway, NJ, USA, Jun. 1, 2009, pp. 1-4.

* cited by examiner

DUAL BAND ANTENNA, IN PARTICULAR FOR SATELLITE NAVIGATION APPLICATIONS

The invention relates to a dual band antenna designed in microstrip technology, which is to be used in particular for satellite navigation applications.

Future navigation systems require more-precise and more-reliable satellite receivers which must have a small size. Further, satellite receivers for navigation systems usually have to receive radiation having frequencies in two frequency bands, wherein the electromagnetic waves which are to be received are waves with circular polarization. Thus, for instance, the European GALILEO satellite system operates in two frequency bands, namely the E5a-E5b-frequency band (1.164 to 1.215 GHz) and the L1-frequency band (1.559 to 1.591 GHz), and requires a high polarization purity. In this system, it is additionally demanded that the reception of waves lying outside these frequency bands is strongly suppressed.

It is known that, for electromagnetic radiation with circular polarization, use can be made of dual band antennae in microstrip technology. Examples of such antennae are found in "DUAL APERTURE-COUPLED MICROSTRIP ANTENNA FOR DUAL OR CIRCULAR POLARISATION", A. Adrian, D. H. Schaubert, ELECTRONIC LETTERS, Nov. 5, 1987, Vol. 23, No. 23, and "Analysis of an Aperture Coupled Microstrip Antenna", Peter L. Sullivan, Daniel H. Schaubert, IEEE TRANSACTIONS ON ANTENNAS AND PROPAGATION, Vol. AP-34, No. 8, August 1986.

In these known antenna designs, the signal received by the antenna element of the microstrip antenna will be coupled through an aperture in the ground layer onto a conductive path. Since the antenna is intended to receive electromagnetic radiation in two frequency bands, the signals of the different frequency bands subsequently have to be divided by means of electronic components such as e.g. so-called splitters. This additional hardware will entail an increased space requirement and also cause additional weight, both of which should be avoided.

From "A Dual-Band Circularly Polarized Aperture-Coupled Stacked Microstrip Antenna for Global Positioning Satellite", David M. Pozar, Sean M. Duffy, IEEE TRANSACTIONS ON ANTENNAS AND PROPAGATION, Vol. 45, No. 11, November 1997, and "Dual Circularly-polarized Stacked Patch Antenna for GPS/SDMB", Jun-Hwa Oh, Young-Pyo Hong, and Jong-Gwan Yook, proceedings of the 2008 IEEE International Symposium on Antennas and Propagation, July 2008, microchip antenna designs for satellite systems are known wherein mutually superimposed antenna elements are used for reception of electromagnetic radiation in respectively different frequency bands which, via apertures in a ground layer (electrically conductive layer) are coupled to different conductive paths. It has turned out that, in these known antenna designs, the separation of the two channels of the antenna is not sufficiently wide for certain satellite navigation applications.

It is an object of the invention to provide a dual band antenna, in particular for satellite navigation applications, which due to its design and particularly without electrical or electronic additional components is configured to deliver, via separate output terminals, signals in the two frequency bands.

To achieve the above object, there is proposed, according to the invention, a dual band antenna, in particular for satellite navigation applications, comprising a multilayer structure provided with an upper, first antenna element for receiving electromagnetic waves having a frequency in a first frequency band, a lower, second antenna element arranged below the first antenna element for receiving electromagnetic waves having a frequency in a second frequency band, two electrically conductive ground layers, a first one and second one, arranged one above the other and both arranged below the lower, second antenna element, and a conducting-path layer having at least one first conductive path for electromagnetically coupling with the first antenna element and having at least one second conductive path for electromagnetically coupling with the second antenna element, the first ground layer facing the lower, second antenna element comprising an aperture, below which the at least one second conductive path extends, the at least one first conductive path being connected to the upper, first antenna element by means of an electrical conductor which extends through the first ground layer and the lower, second antenna element and is electrically insulated from the first ground layer and the lower second antenna element, a first line adjustment element coupled with the at least one first conductive path for suppressing the coupling, into the first conductive path, of electromagnetic waves having a frequency in the second frequency band which are received via the lower, second antenna element and coupled into the electrical conductor, a second line adjustment element coupled with the at least one second conductive path for suppressing the coupling, into the second conductive path, of electromagnetic waves in the first frequency band which are received via the upper, first antenna element, and a plurality of dielectric layers arranged between the antenna elements, the ground layers, and the conducting-path layer that are located one above the other.

The dual band antenna of the invention is provided with two antenna elements (patch) configured for reception and respectively transmission of electromagnetic waves of respectively one frequency in one of two frequency bands. These two antenna elements are arranged above each other and are insulated from each other by one or a plurality of dielectric layers. Generally, the geometric shape of the two antenna elements can be selected at random. Preferably, each antenna element has a substantially circular, substantially rectangular or substantially square geometric shape. Suitably, the two antenna elements are arranged above each other in such a manner that their geometric centers of gravity are arranged on an axis extending substantially at a right angle to the antenna elements. In this arrangement, it is further of advantage if the lower, second antenna element extends beyond the peripheral edge of the upper, first antenna element.

Arranged below the two antenna elements are two electrically conductive ground layers—a first one and a second one—which are located above each other and have a conductive path layer arranged between them, the latter in turn being electrically insulated from the two ground layers by dielectric layers. The first, upper ground layer, which is facing toward the lower, second antenna element, is provided with at least one aperture below which a (second) conductive path of the conductive path layer is arranged. Thus, via said aperture, the signal received by the lower, second antenna element will be coupled onto the (second) conductive path.

For coupling the upper, first antenna element, to a first conductive path of the conductive path layer, use is made of a physical electrical connection in the form of a conductor which extends in the direction of the succession of the layers of the multilayer structure and through said structure, between the conductive path layer and the first antenna element. For this purpose, the lower, second antenna element and the first ground layer facing thereto are each provided with an aperture, wherein an electrical conductor extends through these apertures—while leaving a distance to the edges of the apertures on all sides—for connecting the upper, first antenna element to the first conductive path layer. Thus, the signal received by the upper, first antenna element can be transmitted by a wired connection to the first conductive path. A coupling of the second antenna element through which the electrical conductor extends, namely via the aperture of the second antenna element, will be substantially suppressed by corresponding line adjustment elements which are coupled to the first conductive path. For this purpose, it appears suitable to use a line adjustment element for reflection of those electromagnetic waves of a frequency in the second frequency band which are parasitically coupled via the lower, second antenna element.

As already explained above, the coupling of the lower, second antenna element to the second conductive path is performed via the aperture in the first ground layer and thus in the same manner as in usual so-called aperture-coupled microstrip antenna designs. Via this aperture in the first ground layer, however, also the upper, first antenna element will become parasitically coupled into the first conductive path. Thus, for suppression of these parasitically coupled signals, there is coupled to the second conductive path a second line adjustment element serving for impedance adjustment of the second conductive path to the lower, second antenna element whereby in-coupling effects from the upper, first antenna element into the second conductive path will be suppressed. Generally, it is to be said that any type of line adjustment elements can be coupled to the first and second conductive paths. What is decisive is that the first line adjustment element, which is coupled to the first conductive path on which there should be applied—in the ideal case—only the signals having a frequency in the first frequency band, will suppress the in-coupling of electromagnetic waves of a frequency in the second frequency band which are received via the lower, second antenna element and are coupled into the electric conductor. Also, the second line adjustment element, which is coupled to the second conductive path on which there should be ideally applied only the signal having a frequency in the second frequency band, shall suppress the in-coupling into the second conductor path of electromagnetic waves in the first frequency band which are received via the upper, first antenna element.

By the antenna design of the invention, it is rendered possible to pick up the desired signals directly at the two conductive paths, with the signals thus already having been separated from each other in regard to their frequency. Consequently, no need exists anymore for a frequency splitter or the like as required in microstrip antennae with only one pick-up. To the conductive paths, one can now directly connect the required electric/electronic components and respectively the components for the signals, carried by the conductive paths, which comprise the received waves that normally are polarized waves.

The dual band antenna of the invention can be used as a transmission and/or reception antenna for linearly or circularly polarized waves. The GALILEO satellite system operates with right-hand circularly polarized waves. The components for circularly polarized waves comprise two input terminals, which is why the inventive dual band antenna comprises, for this application, two first conductive paths and two second conductive paths that, as described above for the first and second the conductive path, are electrically connected or electromagnetically coupled directly to the two antenna elements.

Figure 2:
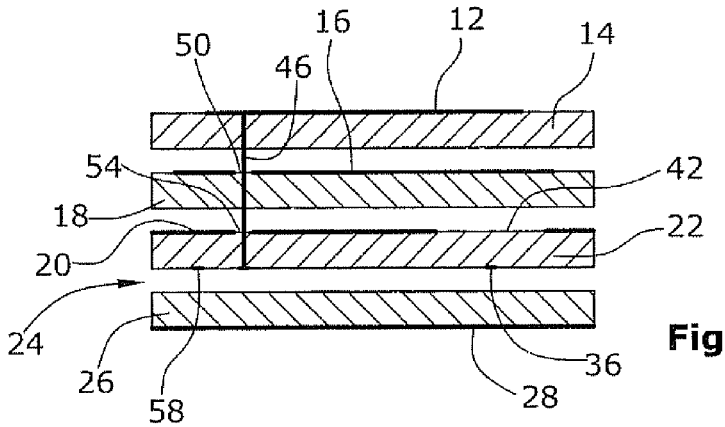
Figure 3:
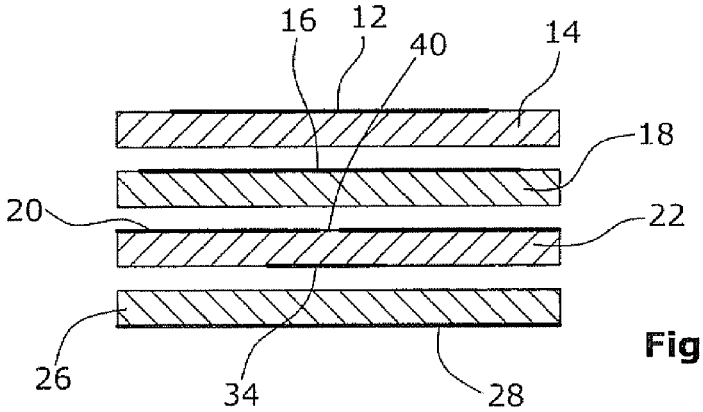
Figure 4:
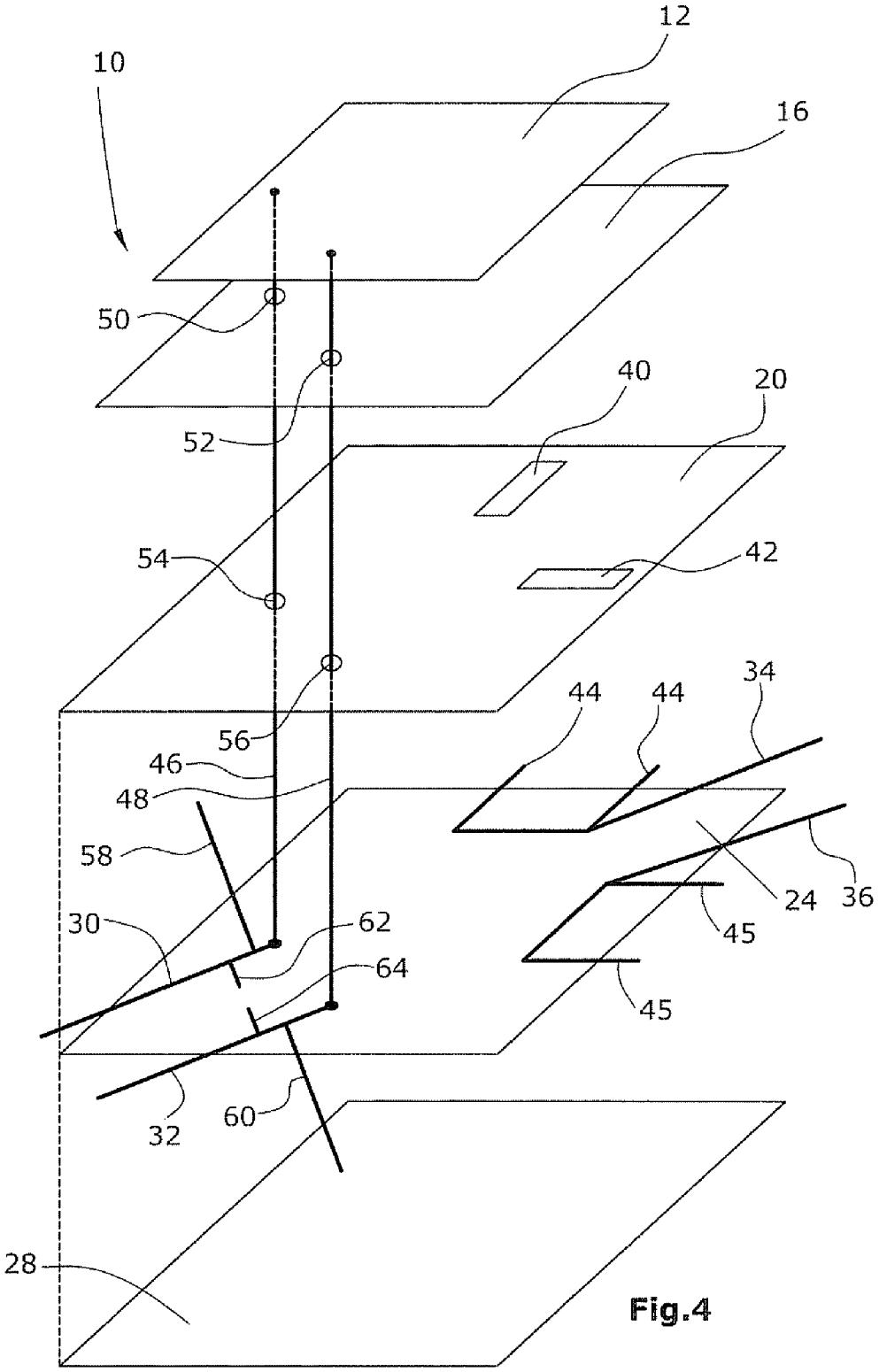

The invention will be explained in greater detail hereunder by way of an exemplary embodiment and with reference to the drawing. In the individual Figures of the drawing, the following is shown:

FIG. 1 is a schematic plan view of a dual band antenna according to said exemplary embodiment, FIG. 2 is a sectional view taken along the line II-II in FIG. 1, FIG. 3 is a sectional view taken along the line III-III in FIG. 1, and FIG. 4 is a perspective exploded view of the layer structure of the dual band antenna.

Illustrate in FIG. 1 is an exemplary embodiment of a dual band antenna 10 for circularly polarized electromagnetic waves, as can be used e.g. in the GALILEO satellite system. The dual band antenna 10 has a multilayer structure comprising electrically conductive layers and, arranged therebetween, dielectric layers, as shown in greater detail in the sectional views of FIGS. 2 and 3 and the exploded view of FIG. 4.

The dual band antenna 10 comprises a first and respectively upper antenna element 12 which in the present embodiment is substantially quadratic and which is operative to receive electromagnetic waves in a first frequency band. Said upper antenna element 12 is arranged on a dielectric layer 14 below which a second, lower antenna element 16 is located. Also the lower antenna element 16 has a substantially quadratic shape. Both antenna elements are arranged centrosymmetrically above each other.

Below said lower antenna element 16, there is arranged a dielectric layer 18 serving for electrical insulation of lower antenna element 16 from a first, upper electrically conductive mass or ground layer 20. Arranged below said upper ground layer 20 is a dielectric layer 22 below which a conductive path layer 24 is arranged, the latter being electrically insulated from a further lower ground layer 28 by means of a further dielectric layer 26. This multilayer structure basically corresponds to the known dual band antenna design by use of microstrip technology.

Said conductive path layer 24 comprises two pairs of conductive paths, one pair of them comprising two first conductive paths 30,32 and the other pair comprising two second conductive paths 34,36. These conductive paths are arranged in a common plane, i.e. in the conductive path layer 24.

Said first conductive paths 30 and 32 are coupled to upper antenna element 12 while said second conductive paths 34,36 are coupled to lower antenna element 16. Thus, when using the dual band antenna 10 as a reception antenna, the signal received by upper antenna element 12 is presented to the first conductive paths 30,32 while the signal received by lower antenna element 16 is presented to the second conductive paths 34 and 36. Now, the main aspect of the dual antenna design resides in that the two channels (namely the first conductive paths 30,32 and the second conductive paths 34,36) are sufficiently decoupled from each other and that, in the ideal case, the signals presented to both channels will be exclusively those signals, with their frequencies, which are assigned to these channels.

The electromagnetic coupling of the lower antenna element 16 to the second conductive paths 34 and 36 is effected, in a manner known per se, via two apertures 40,42 in the upper ground layer 20, wherein the second conductive paths 34,36 extend below respectively one of said apertures 40,42 and traverse the same, as depicted in the Figures. Thus, there is generated an electromagnetic coupling between the lower antenna element 16 and the second conductive paths 34 and 36 via said apertures 40 and 42.

Unintentionally, however, also the upper antenna element 12 will be electromagnetically coupled to the second conductive paths 34 and 36 via the apertures 40 and 42. Now, by use of line adjustment elements 44,45 (so-called impedance matching stubs), the impedance of the second conductive paths 34,36 will be adapted to the impedance of the lower antenna element 16 assigned to these second conductive paths, thereby safeguarding that substantially no signals received by upper antenna element 12 will be coupled into the second conductive paths 34,36.

According to the invention, the electromagnetic coupling of the first conductive paths 30,32 to the upper antenna element 12 assigned to them is performed via a wired connection, namely with the aid of two electrical conductors 46,48 which, starting from conductive path layer 24, extend in the direction of the succession of the various layers of the multilayer structure and through said structure up to the first antenna element 12. In this arrangement, the two conductors 46,48 are electrically insulated from upper ground layer 20 and lower antenna element 16 which are traversed by both conductors. For this purpose, lower antenna element 16 is provided with two apertures 50,52 and the upper ground layer 20 is also provided with two apertures 54,56, wherein the two apertures 54,56 assigned to conductor 46 and the two apertures 52,56 assigned to conductor 48 are respectively aligned with each other.

The signal received by lower antenna element 16 will now become parasitically coupled into the two electrical conductors 46 and 48 and thus be forwarded to the first conductive paths 30 and 32. In the present embodiment, these two first conductive paths 30 and 32 are provided with line adjustment elements 58,60 in the form of $\lambda/4$ decoupling stubs ($\lambda$ being the "guided wave length" of the second frequency band on which the lower antenna element 16 is receiving) so that signals which have been incoupled by the lower antenna element 16 will be reflected and cannot propagate via the first conductive paths 30,32. Additionally, the two first conductive paths 30,32 comprise additional line adjustment elements 62,64 for impedance adjustment (so-called impedance matching stubs).

The dual band antenna design described above and illustrated in the drawing allows for an extremely compact construction and particularly does not require additional electronics for distributing the received signals onto the two frequency bands. The separation of the channels is extremely good; by simulation, it could be demonstrated that the insulation between the two channels is about 30 dB.

As schematically shown in FIG. 1, it is now possible to connect electrical or electronic components/building elements 66,68 (so-called 90°-hybrids) to the two first conductive paths 30 and 32 and respectively to the two second conductive paths 34 and 36, as required for the reception (or transmission) of circularly polarized electromagnetic waves. Then, at the outputs 70,72 of these components 66,68, the signals received by the two antenna elements 12,16 can be picked up separately from each other and as a small-bandwidth signal for further processing in a satellite receiver (or satellite transmitter).

The invention claimed is:

1. A dual band antenna, in particular for satellite navigation applications, comprising a multilayer structure provided with an upper, first antenna element for receiving electromagnetic waves having a frequency in a first frequency band, a lower, second antenna element arranged below the first antenna element for receiving electromagnetic waves having a frequency in a second frequency band, two electrically conductive ground layers, a first one and a second one, arranged one above the other and both arranged below the lower, second antenna element, and a conducting-path layer having at least one first conductive path for electromagnetically coupling with the first antenna element and having at least one second conductive path for electromagnetically coupling with the second antenna element, the first ground layer facing the lower, second antenna element comprising an aperture, below which the at least one second conductive path extends, the at least one first conductive path being connected to the upper, first antenna element by means of an electrical conductor which extends through the first ground layer and the lower, second antenna element and is electrically insulated from the first ground layer and the lower second antenna element, a first line adjustment element coupled with the at least one first conductive path for suppressing the coupling, into the first conductive path, of electromagnetic waves having a frequency in the second frequency band which are received via the lower, second antenna element and coupled into the electrical conductor, a second line adjustment element coupled with the at least one second conductive path for suppressing the coupling, into the second conductive path, of electromagnetic waves in the first frequency band which are received via the upper, first antenna element, and a plurality of dielectric layers arranged between the antenna elements, the ground layers, and the conducting-path layer that are located one above the other.

2. The dual band antenna according to claim 1, wherein the two antenna elements are substantially rectangular and particularly substantially quadratic.

3. The dual band antenna according to claim 1, wherein the two antenna elements are aligned to each other with regard to their geometrical centers of gravity and are arranged above each other, the lower antenna element extending beyond the edge of the upper, first antenna element.

4. The dual band antenna according to claim 3, wherein the lower antenna element extends beyond the edge of the upper, first antenna element on all sides.

5. The dual band antenna according to claim 1, wherein two first and two second conductive paths are provided, the two first conductive paths are connected to the upper, first antenna element by respectively one electrical conductor extending through the first ground layer and the lower, second antenna element while being electrically insulated from these, both first conductive paths are connected to a respective first line adjustment element and the two second conductive paths are connected to a respective second line adjustment element, and the two first conductive paths are configured for connection thereto of a first component for circularly polarized waves having a frequency in the first frequency range, and the two second conductive paths are configured for connection thereto of a second component for circularly polarized waves having a frequency in the second frequency range.

6. The dual band antenna according to claim 1, wherein each first line adjustment element is configured for reflection of electromagnetic waves of a frequency in the second frequency band which have been coupled into the electrical conductor via the lower, second antenna element, and each second line adjustment element is configured for adapting the impedance of the second conductive path to the lower, second antenna element for coupling into the second conductive path substantially only electromagnetic waves of a frequency in the second frequency band.

7. The dual band antenna according to claim 1, wherein each first line adjustment element is configured for reflection of electromagnetic waves of a frequency in the second frequency band which have been coupled into the electrical conductor via the lower, second antenna element, or each second line adjustment element is configured for adapting the impedance of the second conductive path to the lower, second antenna element for coupling into the second conductive path substantially only electromagnetic waves of a frequency in the second frequency band.

8. A method for communicating with a satelite for navigation of the satellite, comprising using a dual band antenna according to claim 1 to transmit signals to or receive signals from the satellite.

9. The method according to claim 8, wherein the dual band antenna is used for transmitting or receiving linearly or circularly polarized waves.

* * * * *